US005295437A

United States Patent [19]

Philippe

[11] Patent Number: 5,295,437

[45] Date of Patent: Mar. 22, 1994

[54] OFFSET PRINTING PROCESS AND CORRESPONDING APPARATUS

[75] Inventor: Michel Philippe, Vienne, France

[73] Assignee: Pechiney Emballage Alimentaire, Clichy, France

[21] Appl. No.: 36,872

[22] Filed: Mar. 25, 1993

[30] Foreign Application Priority Data

Mar. 26, 1992 [FR] France ..... 92 04258

[51] Int. Cl.[5] ..... B41F 23/04

[52] U.S. Cl. ..... 101/487; 101/348; 101/470

[58] Field of Search ..... 101/487, 348, 349, 350, 101/169, 198, 363, 361, 367, 329, 330, 331, 470

[56] References Cited

U.S. PATENT DOCUMENTS

| | | | |
|---|---|---|---|
| 2,260,364 | 10/1941 | Case | 101/487 |
| 2,971,460 | 2/1961 | Shindle | 101/487 |
| 3,230,106 | 1/1966 | West | 101/487 |
| 3,741,115 | 6/1973 | Keller | 101/350 |
| 3,885,496 | 5/1975 | Breitweg et al. | 101/363 |
| 3,956,986 | 5/1976 | Wirz et al. | 101/350 |
| 5,074,213 | 12/1991 | Kurosawa | 101/487 |
| 5,129,320 | 7/1992 | Fadner | 101/365 |
| 5,189,960 | 3/1993 | Valenti et al. | 101/487 |
| 5,218,905 | 6/1993 | Bolte et al. | 101/348 |

*Primary Examiner*—Eugene H. Eickholt

*Attorney, Agent, or Firm*—Dennison, Meserole, Pollack & Scheiner

[57] ABSTRACT

A dry offset printing process using a printing apparatus including a) at least one inker block, each block inking a relief plate corresponding to one color of the final motif to be reproduced on an object and including an inker and a succession of transfer rollers, and b) a central blanket which can be placed into contact with the object to be decorated. An ink of suitable tackiness is selected, and the temperature of the ink is regulated in the inker to a predetermined temperature between 15° and 30° C.

8 Claims, 3 Drawing Sheets

OFFSET PRINTING PROCESS AND CORRESPONDING APPARATUS

BACKGROUND OF THE INVENTION

1. Field of the Invention

The invention relates to a process and apparatus for offset printing, and more particularly to a process and apparatus for dry offset printing on objects with a non-absorbent surface.

2. Description of Related Art

What is known as "offset" printing is generally based on the use of a plate, of which a "hydrophobic" part is inked, as opposed to a "hydrophilic" part that is moistened with water, which in turn repels the ink.

The technique known as "dry offset" printing is accordingly more applicable in certain aspects to typography than to offset printing.

In particular, dry offset printing generally uses inks in the tint of the decoration to be made and makes no, or only slight, use of the four color process with which any decoration can be made from what are known as "primary" inks (yellow, magenta, cyan).

The principle of dry offset printing is illustrated in FIG. 1. Generally, a conventional apparatus includes:

A plurality of inking blocks (one inking block BEi per color or corresponding ink Ei), each one inking a relief plate (CRi) mounted on a drum, corresponding to one color of the final pattern to be reproduced on an object.

Each inking block BEi includes an inker and a succession of transfer rollers intended to obtain a regular and constant thickness of ink on each inked plate.

A central blanket mounted on the drum, each of the relief plates (CRi) being in contact with the rubber blanket (BL) in such a way that each decorative element on each of the plates (CRi) is transferred to the blanket, and that upon each rotation of the blanket one complete decoration is formed on the blanket.

Means making it possible to put the central blanket into contact with a drum carrying the object to be decorated OD, and means for transferring the objects before and after decoration, the object being either a sheet mounted on the drum, or more often an object with a cylindrical or frustoconical surface of revolution.

In operation, heating of the ink is observed from the inker to the relief plate, where the ink typically reaches a temperature of 40° C. Corresponding to this heating of the ink is a related lessening in tackiness, that is, in the inclination an ink has of being transferred from one ink transfer roller to the next roller.

Tackiness is an essential characteristic of a dry offset ink and is measured with the aid of a tackometer, which in the case of the apparatus used by the present applicant functions in accordance with the drawing in FIG. 2.

In using a dry offset printing apparatus according to the prior art, applicant has observed several types of problems Difficulties in obtaining saturated tints, particularly in the case where bar codes are produced with a black ink, which is a prohibitive defect, since it makes reading the bar code difficult (several attempts being necessary to successfully read the bar code), or even impossible: the overly liquid ink has been unable to accumulate thickly enough.

Second, difficulties in obtaining tints of constant intensity over the course of production, requiring permanent modification of the settings of the machine and local pressure on the inking blade, which may lead to the development of undesirable residues in the inker.

Finally, the appearance of powdered deposits on the surface of the printed object after drying of the ink is sometimes noted, whether drying is done by thermal radiation (IR) or UV.

These problems arise despite proper adjustment of the dry offset printing equipment.

SUMMARY OF THE INVENTION

The process according to the invention for dry offset printing uses a dry offset printing apparatus including a) at least one inker block, each such block inking a relief plate corresponding to one color of the final motif to be reproduced on an object and including an inker and a succession of transfer rollers, b) a central blanket mounted on a drum, each of the relief plates being in contact with this rubber blanket in such a way that upon each rotation of the blanket, one complete decoration is transferred to the blanket, c) means for placing the central blanket into contact with a drum bearing the object to be decorated, and d) means for transferring the objects before and after decoration. In order to obtain a decoration with a regular and adequate thickness of ink, 1) the temperature of the ink in the inker is regulated to a predetermined temperature between 15° and 30° C.; and 2) an ink having a tackiness adapted to the job on the offset press is selected, the ink having an acceptable tackiness at the predetermined temperature between 15°-30° C., corresponding to the temperature of the ink in the inker, the acceptable tackiness being 3-5 times greater than the tackiness of the same ink after its temperature has been increased by 15° to 25° C., corresponding to the temperature increase of the ink in passing from the inker to the blanket.

In studying the problem presented, the applicant has observed the consequences of unsuitable tackiness:

If the tackiness is too high, this certainly causes a major transfer of ink from roller to roller, but also an overly high shearing force of the ink, which requires a driving force such that the motors that actuate the transfer rollers may be completely damaged.

If the tackiness is too low, the transfer of the ink is poor, and the ink has a tendency to dam up and accumulate between two transfer rollers.

The present applicant has found that it is sufficient to act simultaneously upon the selection of the starting inks and on the temperature of the ink in the inker to solve the problems presented. One of ordinary skill in the offset printing art can determine an acceptable tackiness for ink in the inker, and select an ink having acceptable tackiness at a temperature between 15° and 30° C., the temperature to which the ink in the inker will be regulated. It is to be noted that it is common practice in the art to determine tackiness in relative units only, depending on the method of measurement, and not in absolute units.

Preferably, the temperature of the ink in the inker is thermoregulated between 20° and 25° C., plus or minus 1° C.

Typically, the ink selected is kept at 22° C.±1° C., and this makes it possible to perform a long series of offset printing jobs without having to constantly readjust the machine settings. At this temperature, the ink in the inker also has a viscosity that allows stable and sufficient discharge of ink under the inking blade.

The applicant has also been able to demonstrate that powdered traces no longer appear on the surface of the object to be decorated, which the applicant has theorized to be due to the probable presence in the formulation of the starting ink of thermosensitive compounds, which under the conditions in the prior art could instantaneously be at a temperature greater than that appropriate for their range of stability.

The curve of tackiness of an ink according to the invention is shown in FIG. 3.

To keep the ink of the inker at a temperature between 15° and 30° C., a circulation of water is typically used, at a temperature less by 5° to 15° C. than the temperature intended for this ink in the inker, which can be achieved by a circulation in the material forming the inker or in the ink itself, by means of thermal regulation equipment known per se.

Since not all inks are equally vulnerable to the problems discussed in the present application, it is possible that the process of the invention may be applied only to inks that are subject to these problems, but it is preferable for all the inks and inkers to be handled identically according to the invention, because this makes it easier to obtain a permanent, stable mode of operation on the machine (stability of the ink temperatures) and clearly contributes to the final quality of the decoration.

In one embodiment of the invention, the temperature of the ink is measured at a plurality of points along the chain of transfer of the ink, from the inker to the blanket, with the aid of a pickup, preferably an infrared pickup, and the temperature in the inker is regulated as a function of the temperature of the ink on the rollers, and/or on the relief plate, and/or on the blanket, and/or on the printed object, in such a way as to prevent the ink temperature from exceeding 45° C.

The apparatus according to the invention, intended for employing the process of the invention, includes at least one inker thermoregulated with the aid of a fluid at a constant temperature that is less by 5° to 15° C. than the temperature of the ink in the inker. In fact, the ink in the inker is permanently subjected to the shearing force of the first transfer roller, thereby necessitating a sufficient difference in temperature between that of the fluid and that of the ink.

Preferably, the apparatus includes means for measuring the temperature at at least one point along the chain of transfer of the ink, from downstream of the inker to the printed object, in order to control this thermoregulation of the ink in the inker.

By replacing the ink in the inker with a varnish, the same apparatus makes it possible to deposit a layer of varnish of slight (typically less than 5 μm) and regular thickness on an object to be varnished, for instance for the purpose of protecting the inks or to make them more brilliant. Accordingly, the term "ink" as used herein includes varnishes as might also be deposited by offset printing equipment.

BRIEF DESCRIPTION OF THE DRAWINGS

The invention will be better understood with reference to the attached drawings in which.

DESCRIPTION OF THE PREFERRED EMBODIMENTS

Figure 1:
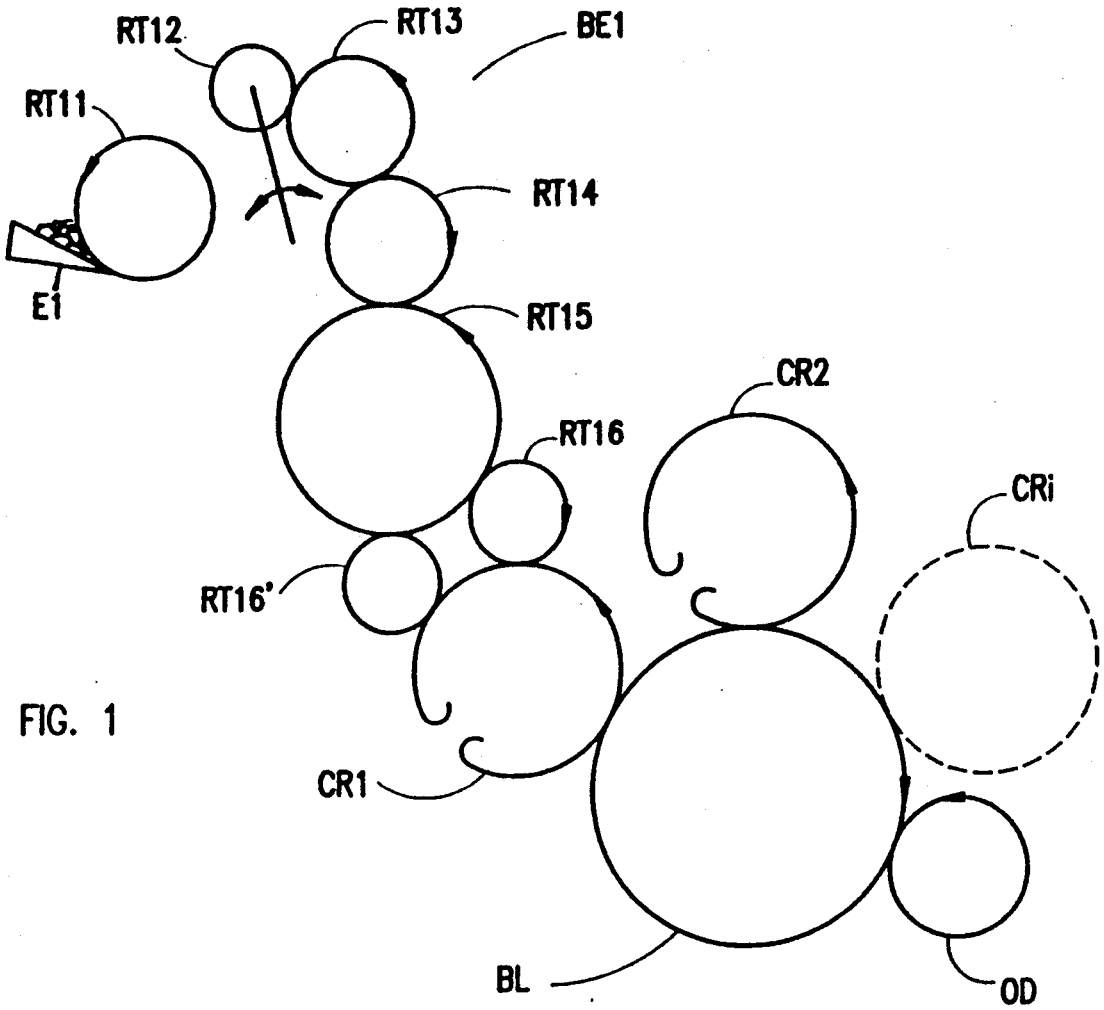
FIG. 1 shows schematically the basic layout of a dry offset printing machine according to the prior art.

FIG. 1 shows the basic layout of a dry offset printing machine, including:

a) A plurality of inker blocks (only one of which, BE1, is shown in FIG. 1), each inking a relief plate. Two relief plates, CR1 and CR2, are shown in FIG. 1, each corresponding to an inker block and hence to one color of the final motif to be reproduced on an object. Each inker block includes an inker E1 and a succession of transfer rollers, RT11, RT12, RT13, RT14, RT15, RT16, RT16'. It may be noted that the second transfer roller RT12 effects a reciprocating motion between the first and third transfer rollers, RT11 and RT13.

b) A central blanket BL mounted on a drum, each of the relief plates, CR1, CR2, CRi, being in contact with this rubber blanket in such a way that one complete decoration is transferred to the blanket upon each rotation of the blanket;

c) An object to be decorated OD, mounted on a drum, in contact with the blanket BL, onto which the blanket is to transfer the complete decoration.

Figure 2:
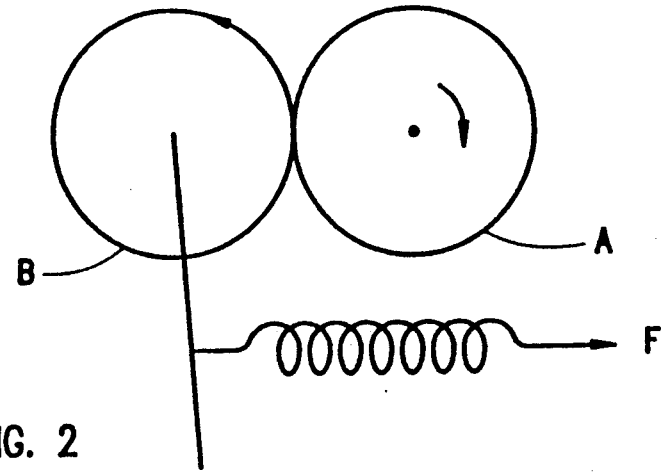
FIG. 2 shows schematically the adaptation of the principal of tackometry to a dry offset printing machine according to the invention.

FIG. 2 illustrates the principle of tackometry utilized by the applicant. It includes two rollers:

A drive roller A rotating at a speed that may vary. This roller, which is temperature regulated, receives the ink to be tested.

A roller B, which rotates freely, is pressed against the roller A by a force F intended to maintain the contact between the two rollers, in order to compensate for centrifugal force that tends to move rollers B away from roller A.

For a given ink and a given rotational speed and temperature of the roller A, the measurement of the force F is inverse relationship with the tackiness: the lower the tackiness, the more fluid the ink, the lower the shear forces due to the ink between the rollers A and B, and the higher the force F required for keeping the rollers A and B in contact.

The tackometer is graduated in empirical units, which are not directly related to fundamental units of measurement.

Both the tackometer used here and a commercially available apparatus, such as the Tackoscope ® made by Testprint, work by a related principle and produce similar results.

Figure 3:
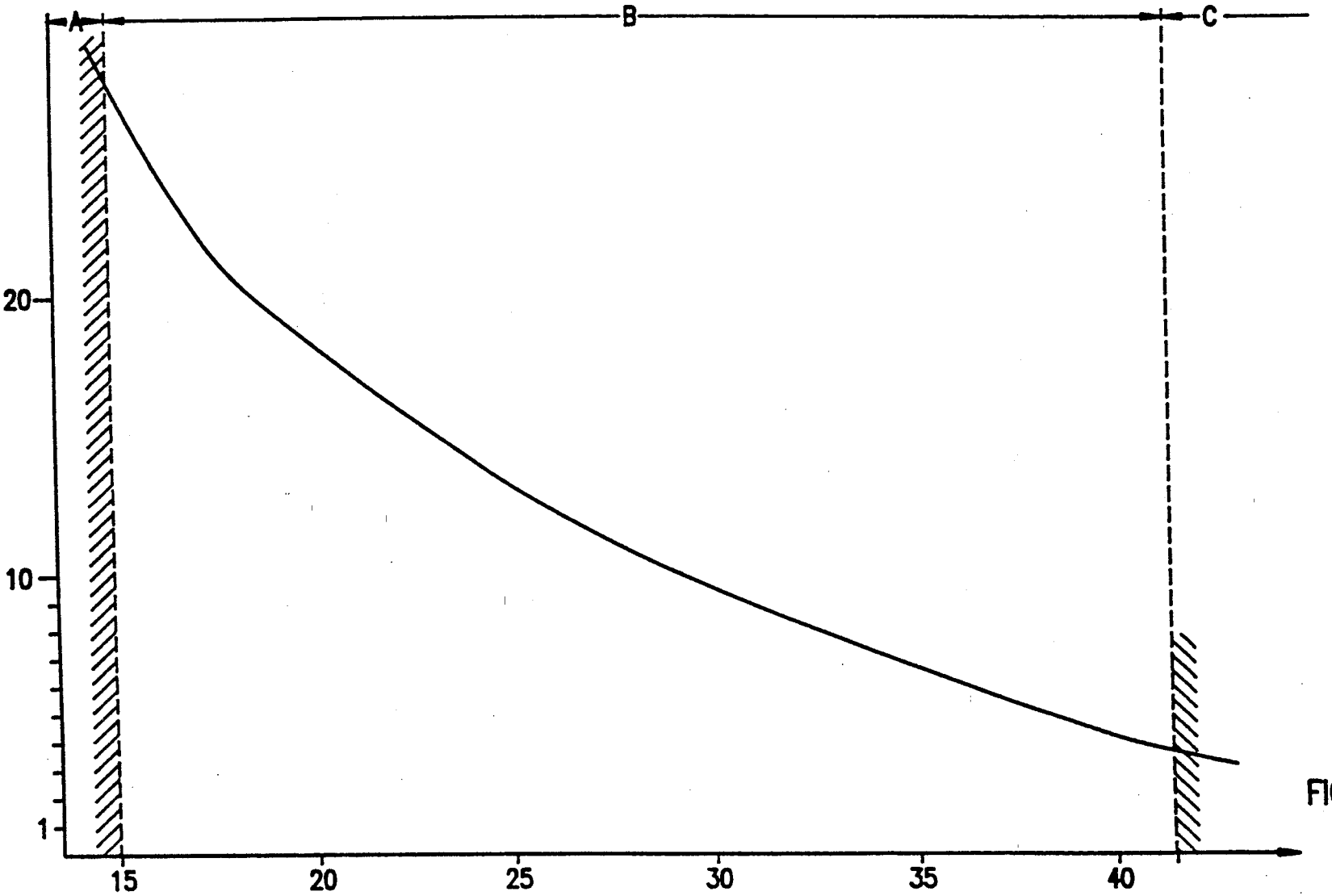
FIG. 3 is a curve of tackiness versus temperature for an ink according to the invention.

FIG. 3 shows a typical curve of the tackiness in relative units at a constant roller speed (y-axis) versus the temperature in ° C. of an ink selected according to the invention (x axis). The tackiness t varies from 28 at 15° C., to 13 at 25° C., and 4 at 40° C. Three temperature ranges are defined on this curve: range A, where the temperature is less than 15° C. and consequently the ink is too "adhesive" to allow the offset machine work, range B, or "working range", and range C, beyond approximately 40° C., where the overly fluid ink transfers poorly from one roller to the other and forms an imprint of overly low ink thickness on the object to be decorated. In accordance with the invention, tackiness at 25° C. is 3–5 times the tackiness at 40° C., corresponding to a typical temperature difference in the ink between the inker and the blanket.

Figure 4:
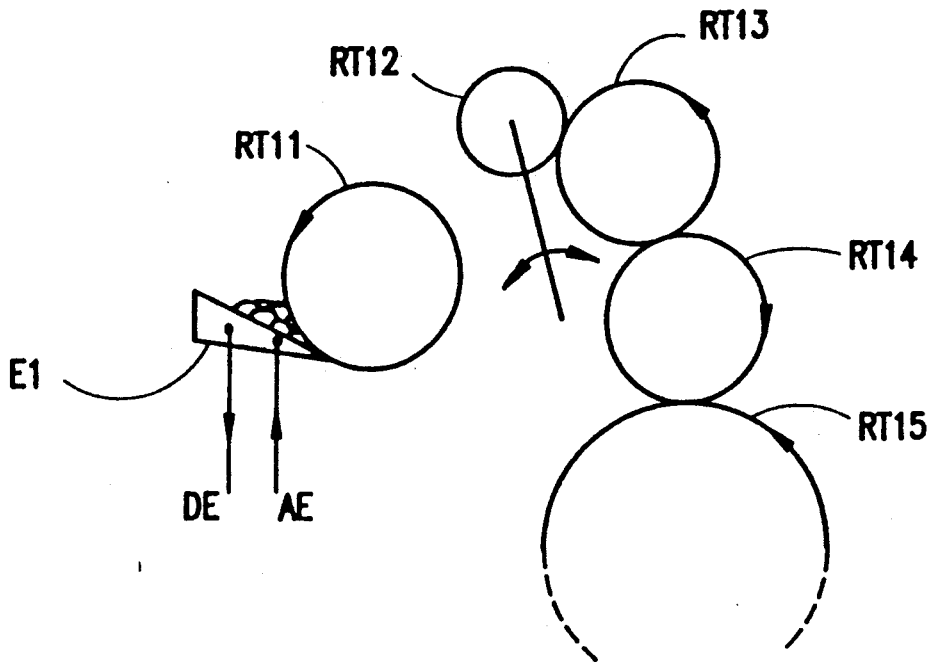
FIG. 4 shows schematically a modification of an inker in accordance with one embodiment of the invention.

FIG. 4 shows the part of FIG. 1 that relates to the inker and is modified in accordance with one embodiment of the invention, with regulation of the temperature of the ink represented by a thermoregulated circulation of water in the body of a metallic inker, with water inlet AE and water outlet DE.

EXAMPLES

The same decoration, made by the prior art and made by the invention, on the same object to be decorated (transparent pot of polypropylene) has been compared, with two different offset inks for UV drying, a red ink, and a black ink available on the market.

The same starting inks were used for two tests on industrial production machinery.

The test according to the invention was done on the offset machine provided according to the invention, using an inker thermostatically controlled by a circulation of water at 10° C., in such a way as to obtain an ink in the inker at 22° C., ±1° C., the machine regulation and the adaptation of the ink tackiness being done by the operator in a manner appropriate for each test, in accordance with the typical experience of one skilled in this field.

It is not conveniently possible to describe all the settings of the machine and preparations of the ink that the operator on a dry offset machine performs.

Hence the comparison bears on the results obtained, from the same commercial ink after selection of the ink by examining its curve of tackiness as a function of temperature, with the same decoration, the same industrial dry offset machine, and the same operator regulating his machine to obtain the densest possible decoration in steady state operation.

The optical density was measured with a Macbeth Colorchecker, model 1145.

Comparison of the Red Color (with Cyan Filter)

Optical density of the prior art print: 1.03

Optical density of the print of the invention: 1.158

Comparison of the black color (reference white assumed equal to 100%):

Measured on white background—prior art: 0.75

Measured on white background—invention: 0.330.

The black obtained according to the invention is much deeper than obtained by the prior art, and its legibility to the bar code reader is completely different, since bar codes, whose legibility in the prior art was sporadic, become reliably 100% legible, as has been demonstrated in comparative tests In these comparative tests, measurements made with a white ink have shown that with the invention the ink thickness can be doubled, changing it typically from 1.2 μm to 2.4 μm.

By making relatively inexpensive modifications to existing machines (compared with air conditioning a factory or thermoregulating all the rollers in an offset machine), the invention makes it possible to solve one essential problem in dry offset printing, in particular of printing packages provided with bar codes.

The legibility of bar codes is in fact an essential requirement for distribution channels, in the sense that stores are increasingly being equipped with automatic scanners for reading the information contained in the bar codes, essentially the price and the code of the article.

The invention also makes it possible to greatly improve the aesthetic qualities of the products printed according to the invention, and to markedly lower production costs (handling) because of the major improvement in the stability of the printing process of the invention.

What is claimed is:

1. A dry offset printing process using a dry offset printing apparatus including a) at least one inker block for transferring ink to a relief plate corresponding to one color of a final motif to be reproduced on an object and including an inker and a succession of transfer rollers, b) a central rubber blanket mounted on a rotatable drum and in contact with a relief plate in such a way that upon each rotation of the blanket, one complete decoration is transferred to the blanket, c) means for placing the central blanket into contact with a drum bearing an object to be decorated, and d) means for transferring the objects before and after decoration, comprising the steps of:

1) regulating ink temperature in the inker to a predetermined temperature between 15° and 30° C.; and 2) using an ink with tackiness adapted to a job on the offset apparatus, the tackiness at the predetermined temperature of 15° to 30° C., corresponding to the temperature of the ink in the inker, being 3–5 times greater than the tackiness of the same ink after a temperature increase by 15° to 25° C., corresponding to a temperature increase of this ink in passing from the inker to the blanket.

2. The process of claim 1, wherein the temperature of the ink in the inker is regulated to a predetermined temperature between 20° and 25° C., and to within 1° C. of the predetermined temperature.

3. The process of claim 2, wherein the temperature is regulated by circulating fluid in the ink or in the inker at a temperature lower than the predetermined temperature by up to 15° C.

4. The process of claim 1, 2 or 3, wherein a plurality of inks for decorating an object are temperature regulated, using a separate inker for each ink.

5. The process of claim 1, 2 or 3, wherein the temperature of the ink is measured at a plurality of points along a chain of transfer for the ink from the inker to the blanket, and the temperature in the inker is regulated as a function of the temperature of the ink at a selected point along the chain.

6. The process of claim 5, wherein the temperature of the ink is determined by infrared measurement.

7. The process of claims 5, wherein the temperature of the ink is measured at at least one point selected from the group consisting of the rollers, the relief plate, the blanket, and the printed object.

8. The process of claim 1, wherein the temperature of a varnish is regulated.

* * * * *